US007566139B1

(12) United States Patent
Dority

(10) Patent No.: US 7,566,139 B1
(45) Date of Patent: Jul. 28, 2009

(54) LED ILLUMINATION DEVICE FOR MAGNIFYING VISORS

(76) Inventor: Scott Dority, 2547 Edgewater, Cortland, OH (US) 44410

( * ) Notice: Subject to any disclaimer, the term of this patent is extended or adjusted under 35 U.S.C. 154(b) by 275 days.

(21) Appl. No.: 11/698,432

(22) Filed: Jan. 26, 2007

Related U.S. Application Data

(60) Provisional application No. 60/762,842, filed on Jan. 30, 2006.

(51) Int. Cl.
*F21V 33/00* (2006.01)

(52) U.S. Cl. ..... 362/105; 362/103; 362/253; 362/234

(58) Field of Classification Search ..... 362/103, 362/105, 253, 234, 249, 251
See application file for complete search history.

(56) References Cited

U.S. PATENT DOCUMENTS 5,224,772 A * 7/1993 Fustos ..... 362/105
5,580,163 A * 12/1996 Johnson, II ..... 362/285
5,871,271 A 2/1999 Chien
6,027,235 A * 2/2000 Chen ..... 362/497
6,322,226 B1 * 11/2001 Dickson ..... 362/33
6,384,988 B1 * 5/2002 Muller et al. ..... 359/798
6,483,651 B1 11/2002 Maurer
6,733,150 B1 5/2004 Hanley
6,999,248 B2 * 2/2006 Schuttinger ..... 359/803
2002/0145813 A1 * 10/2002 Jung et al. ..... 359/798
2005/0036191 A1 2/2005 Schuttinger

* cited by examiner

*Primary Examiner*—Laura Tso
(74) *Attorney, Agent, or Firm*—Harpman & Harpman

(57) ABSTRACT

An illumination device for use on magnification headgear that provides for selective magnification of objects. The illumination device comprises detachable perimeter support frame with integrated multiple illumination LED's thereabout for uniform illumination of an object to be viewed. The support frame extends around the magnifying lenses in the headgear and has a remote source of switchable power.

6 Claims, 4 Drawing Sheets

LED ILLUMINATION DEVICE FOR MAGNIFYING VISORS

This application claims benefit of U.S. Provisional Application No. 60/762,842, filed Jan. 30, 2006.

BACKGROUND OF THE INVENTION

1. Technical Field

This invention relates to illumination devices that are associated with head oriented mounting venues to provide for hands free source of illumination conveniently positioned on the head of the user.

2. Description of Prior Art

Prior art devices of this type have been directed to a variety of different user applications, such as clip-on LED lights and incandescent lamps for hats or self-supporting head straps. Also glasses may be fitted with LED light sources with built-in batteries. Other prior art illumination constructions can be seen in U.S. Pat. Nos. 5,871,271, 6,483,651, 6,733,105 and U.S. Patent Publication US 2005/006191 in which a hand held magnifying lens is fitted with multiple LED's for illumination of an object within the field of the magnifier.

SUMMARY OF THE INVENTION

An illumination device for use with magnifying visors that provides for detailed magnification of an object. The illumination device has a source of power supplied by a remote battery pack and integrated activation switches. A lens surrounding frame of the invention is removably secured to the magnifying visor and is fitted with multiple LED's so as to provide for overlapping illumination field that corresponds to the effective magnification focal distance of the magnifying device.

DETAILED DESCRIPTION OF THE INVENTION

Figure 1:
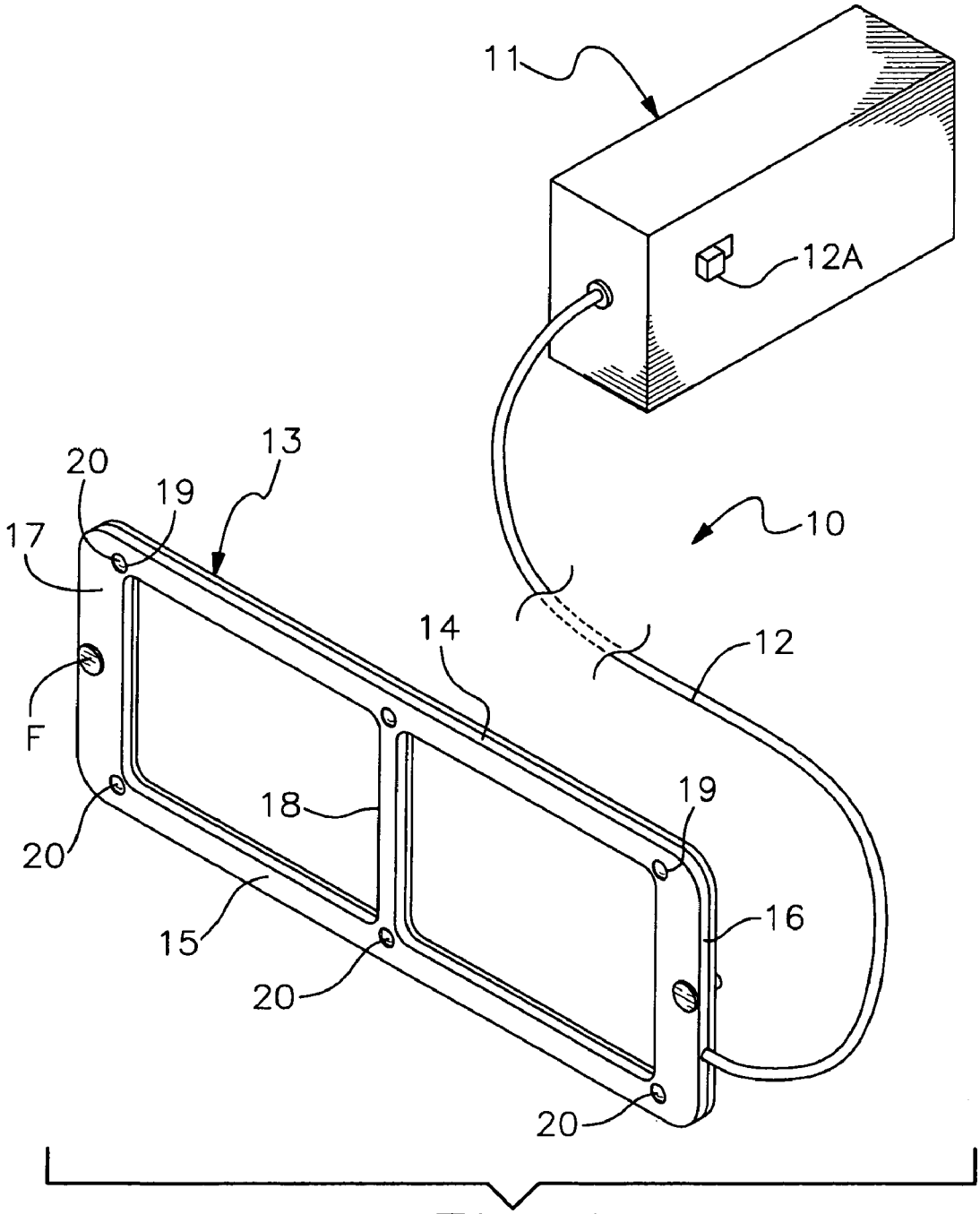
FIG. 1 is a perspective view of the illumination device of the invention with interconnected power pack.
Figure 2:
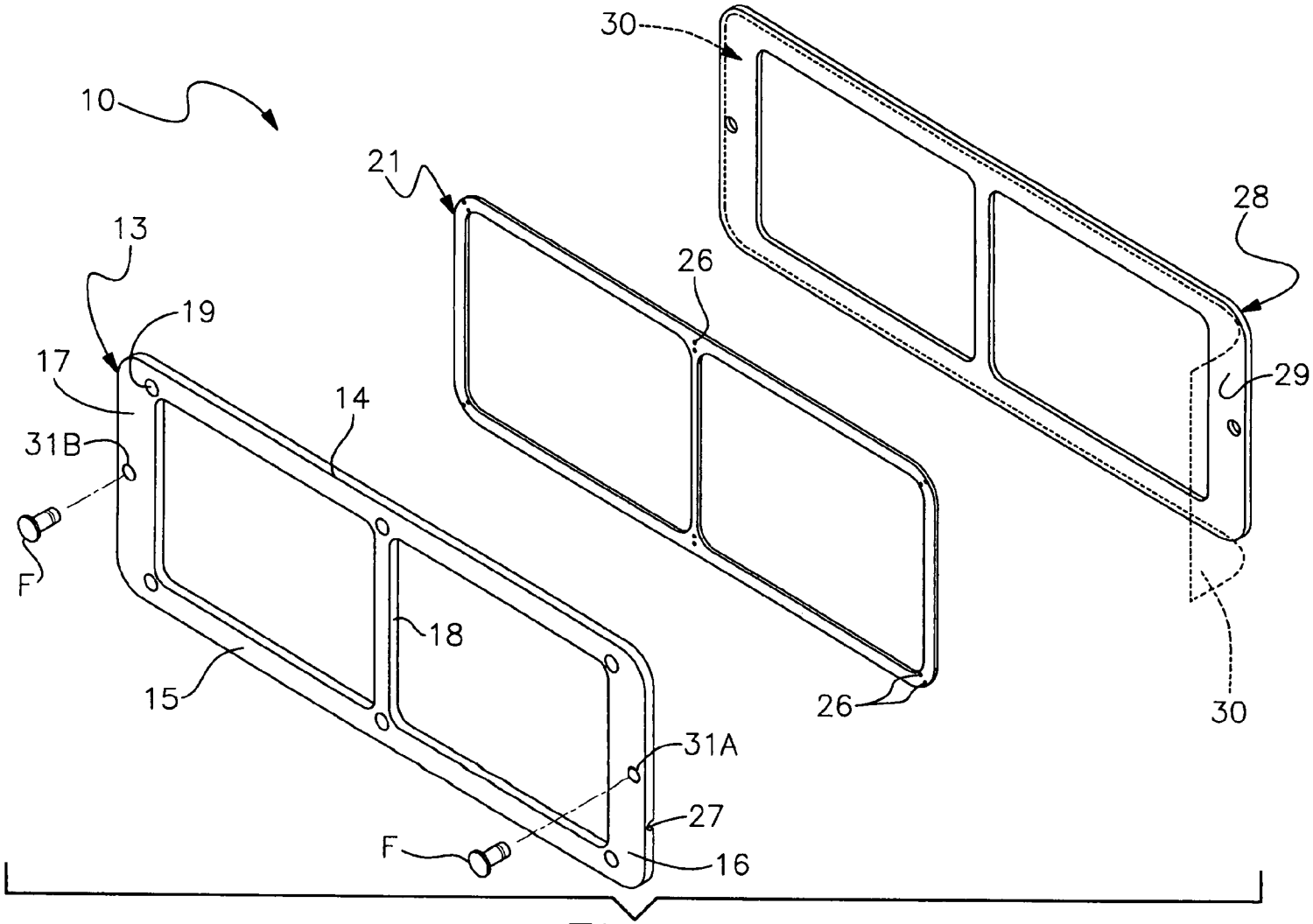
FIG. 2 is an exploded front perspective assembly view of the illumination frame and associated LED's.

Referring to FIG. 1 of the drawings, an illumination device 10 of the invention can be seen interconnected with a battery pack 11 via a power cable 12. The battery pack 11 has switch means 12A for selective power activation of the device.

Illumination device 10 has a main support frame 13 defining a rectangular configuration. The support frame 13 has oppositely disposed spaced parallel upper and lower rails 14 and 15 and interconnecting opposing end rails 16 and 17 with a center dividing rail element 18 midway therebetween.

Figure 3:
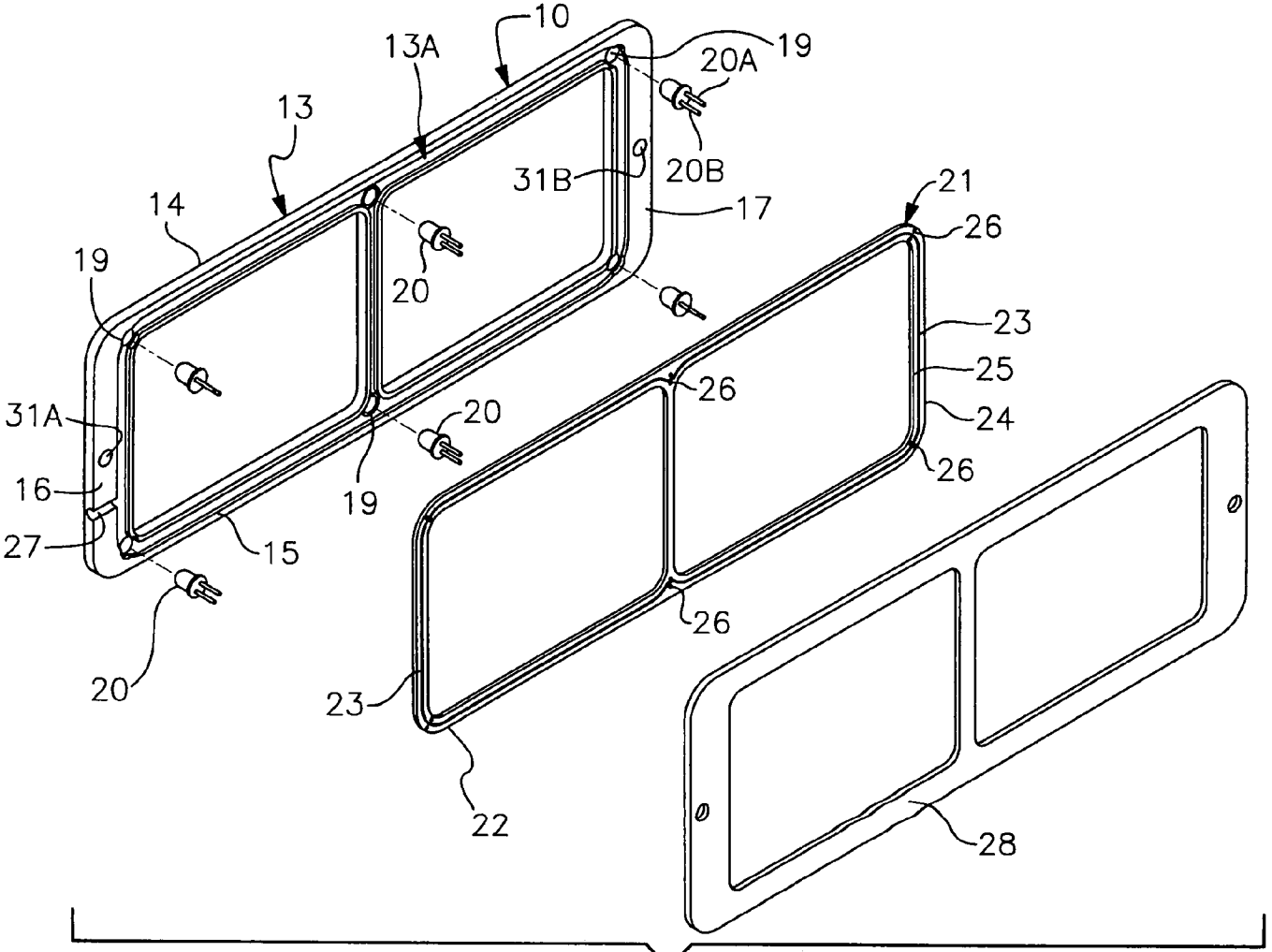
FIG. 3 is an exploded rear perspective assembly view thereof.

A plurality of LED mounting apertures 19 are longitudinally spaced about the perimeter of the frame 13 and in the intersecting center of the dividing element 18. A corresponding number of LED's 20 are pressed fit within the respective apertures 19 with their respective positive and negative power leads 20A and 20B extending outwardly therefrom. An electrical circuit is formed on a custom circuit board 21 of the same divided rectangular configuration as that of the frame 13. The circuit board 21, best seen in FIG. 3 of the drawings has a conductive surface 22 which is divided by a non-conductive strip at 23 defining positive and negative surface areas 24 and 25 respectively.

Pairs of LED lead openings 26 formed within the circuit board 21 for registerable alignment with the respective power leads 20A and 20B as will be well understood by those skilled in the art.

A pair of interface power communication fittings 27 are formed on the rail frame 16 so as to communicate with the respective positive and negative conductive surfaces 24 and 25 of the circuit board 21 when engaged thereon during assembly as which will be disclosed in greater detail hereinafter.

A flexible backing cover plate 28 having an adhesive surface 29 with a release sheet 30 shown in broken lines is of a size and dimension to engage over and to seal the effacing surface of the circuit board 21 when assembled as illustrated in FIG. 1 of the drawings.

Figure 4:
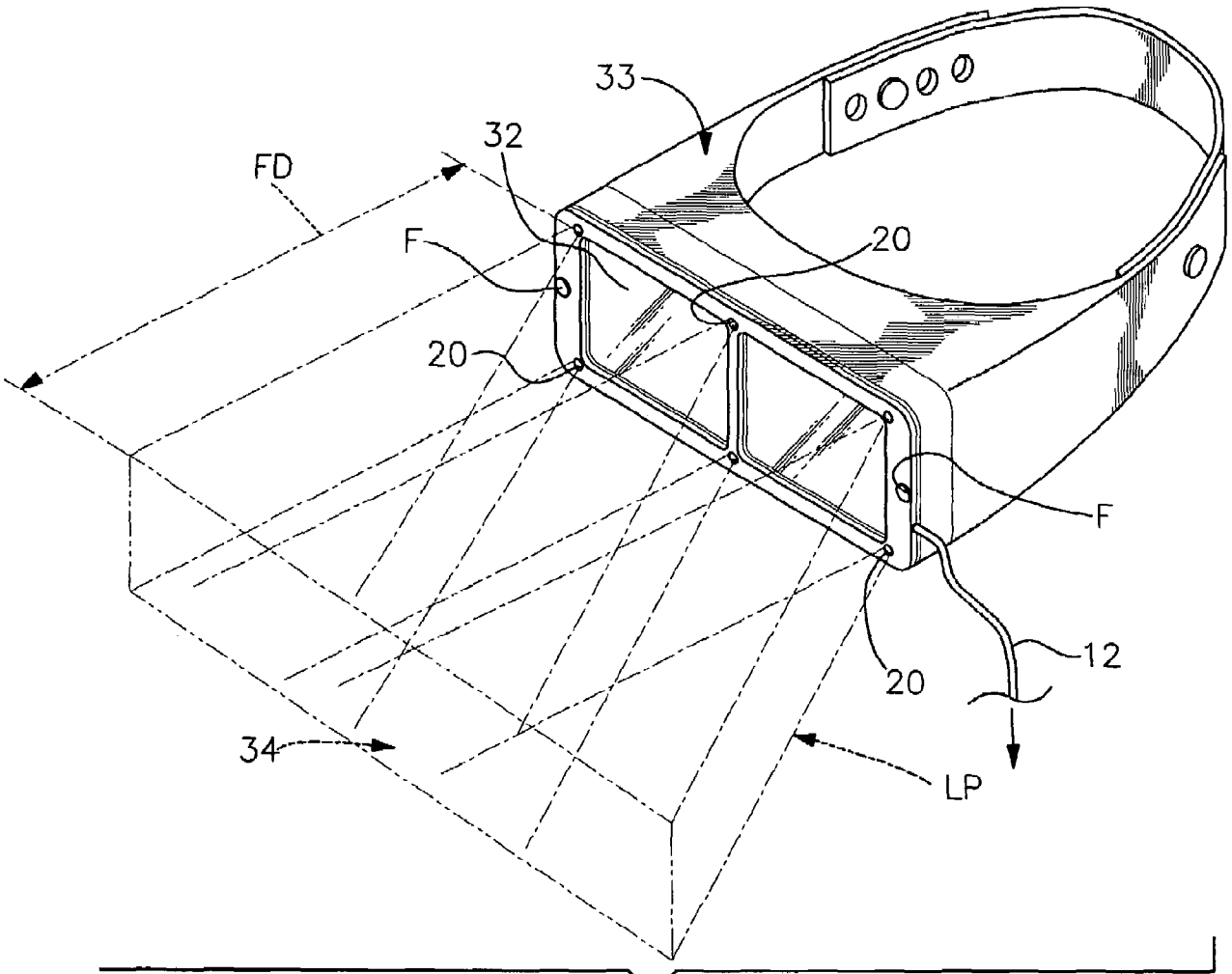
FIG. 4 is a perspective view of a magnifier visor device with the illumination device of the invention attached thereto.

Mounting apertures 31A and 31B are formed on the frame 13 on the respective rail members 16 and 17 for registerable engagement with fasteners F which would be selectively secured therethrough and onto the lens area 32 on a magnifying visor 33 such as one manufactured by Dongon brand name as seen in FIG. 4 of the drawings.

It will be evident from the above description that by positioning the illumination device 10 of the invention on the magnifier visor 33, multiple LED's are so positioned as to form a uniform light field 34 shown by broken lines in FIG. 4 of the drawings. It will be evident that each of the LED's 20 illuminate a path LP defining multiple overlapping cones of illumination defining an illumination light field 34 which corresponds to the specific magnification visor's 33 focal distance which is illustrated in broken lines graphically as FD.

Additional power LED activation control switching (not shown) can be provided for independent power isolation and selection of specific LED's and be mounted within the light visor in certain application processes.

It will thus be seen that a new and useful illumination device or magnification visor has been illustrated and described that can be easily retro-fitted onto an existing magnifying visor 33 over the lens portions providing a unique illumination field at the specific focal distance FD of the visor itself thus providing the proper shadow free illumination of the object to be viewed under magnification within the confines of the field.

It will also be evident that various modifications of the illumination device of the invention can be made to fit other selected magnifying visor configurations still employing the multiple LED configuration surrounding the mounting frame with a unique integrated circuit board and flexible closure plate which is adhesively secured by removal of the release sheet 30 as will be evident and obvious to one skilled in the art.

It will be apparent to those skilled in the art that various changes and modifications may be made thereto without departing from the spirit of the invention.

Therefore, I claim:

1. An illumination device for use with hands free magnifying equipment having magnifying lens comprises, a support frame for mounting and holding multiple illumination sources, said support frame comprising an upper and lower parallel rail members, oppositely disposed end rail members and center dividing rail extending therebetween defining two independent magnifying lens receiving areas, multiple light emitting diodes mounted through said respective rail member intersections with said end and center rail members, said multiple light emitting diodes form a uniform light field in spaced parallel relation to said support frame magnifying lens areas, said light emitting diodes secured to a circuit and defining a conductive surface of an electrical circuit and a source of selective power.

2. The illumination device set forth in claim 1 wherein said light emitting diodes are electrically connected to one another and a remote power source through an electrical switch circuit.

3. The illumination device set forth in claim 1 wherein said light emitting diodes are secured through apertures in said respective rail member intersections in parallel spaced pairs about said lens receiving areas in equilateral relation to one another.

4. The illumination device set forth in claim 1 wherein said support frame further comprises, a backing cover plate overlying said circuit board and said respective interconnected rail members.

5. The illumination device set forth in claim 1 wherein said illumination device is secured to said magnifying equipment by fasteners extending through said respective end rail members support frame.

6. The illumination device set forth in claim 1 wherein said support frame is made of molded synthetic resin material.

* * * * *